US008783511B2

(12) United States Patent
Snodgrass

(10) Patent No.: US 8,783,511 B2
(45) Date of Patent: Jul. 22, 2014

(54) MANUAL AND TOUCH-FREE CONVERTIBLE FLUID DISPENSER

(75) Inventor: David L. Snodgrass, Stuart, FL (US)

(73) Assignee: UltraClenz, LLC, Jupiter, FL (US)

( * ) Notice: Subject to any disclaimer, the term of this patent is extended or adjusted under 35 U.S.C. 154(b) by 1107 days.

(21) Appl. No.: 12/150,223

(22) Filed: Apr. 25, 2008

(65) Prior Publication Data

US 2009/0266842 A1 Oct. 29, 2009

(51) Int. Cl.
*B67D 5/08* (2006.01)

(52) U.S. Cl.
USPC ..... 222/52; 222/181.3; 222/278

(58) Field of Classification Search
USPC ..... 222/52, 63, 325, 333, 179, 179.5, 351, 222/326, 181.3, 278; 141/351
See application file for complete search history.

(56) References Cited

U.S. PATENT DOCUMENTS 4,178,975 A 12/1979 Crespi
4,349,131 A 9/1982 Arabian
4,477,000 A 10/1984 Arabian
4,651,902 A * 3/1987 Hobbs et al. ..... 222/153.09
4,667,854 A 5/1987 McDermott et al.
4,722,372 A 2/1988 Hoffman et al.
4,839,039 A 6/1989 Parsons
4,921,150 A 5/1990 Lagergren et al.
4,946,070 A 8/1990 Albert et al.
4,967,935 A 11/1990 Celest
5,031,258 A 7/1991 Shaw
5,105,992 A 4/1992 Fender et al.
5,199,118 A 4/1993 Cole et al.
5,248,066 A 9/1993 Olson et al.
5,255,822 A 10/1993 Mease et al.
5,310,089 A * 5/1994 Hudgins ..... 222/79
5,377,871 A 1/1995 Banks et al.
5,465,877 A 11/1995 Bell et al.
5,492,247 A 2/1996 Shu et al.
5,556,005 A 9/1996 Banks
5,771,925 A 6/1998 Lewandowski
5,810,204 A 9/1998 Devlin et al.
6,036,056 A 3/2000 Lee et al.
6,125,482 A 10/2000 Foster
6,131,773 A 10/2000 Wade et al.
6,178,572 B1 1/2001 Van Marcke
6,189,740 B1 2/2001 Wade et al.
6,209,752 B1 4/2001 Mitchell et al.
6,347,724 B1 2/2002 Chen et al.
6,404,837 B1 6/2002 Thompson et al.
6,426,701 B1 7/2002 Levy et al.
6,568,561 B2 5/2003 Studer et al.
6,626,332 B2 9/2003 Ehrensperger et al.
6,691,893 B2 2/2004 Gauthier
6,729,506 B2 5/2004 Brown et al.
6,948,638 B2 9/2005 Tu
7,051,987 B2 5/2006 Chen (Continued)

OTHER PUBLICATIONS

Int. Search Report PCT/US09/41653 Dated Jul. 16, 2009.

(Continued)

*Primary Examiner* — Paul R Durand
*Assistant Examiner* — Donnell Long
(74) *Attorney, Agent, or Firm* — Lucas & Mercanti, LLP; Peter J. Phillips

(57) ABSTRACT

A convertible fluid dispenser for dispensing personal care hygiene products has a chassis adapted to accept either a manual actuating unit or an automatic actuating unit, for upgrading or maintenance.

17 Claims, 12 Drawing Sheets

(56) References Cited

U.S. PATENT DOCUMENTS

| | | | | |
|---|---|---|---|---|
| 7,066,355 | B2 | 6/2006 | Lewis et al. | |
| 7,066,356 | B2 | 6/2006 | Schuman et al. | |
| 7,107,631 | B2 | 9/2006 | Lang | |
| 7,278,554 | B2 | 10/2007 | Armstrong | |
| 7,281,643 | B2 | 10/2007 | Lin | |
| 7,364,053 | B2 | 4/2008 | Ophardt | |
| 7,455,197 | B2 | 11/2008 | Ophardt | |
| 2002/0175182 | A1* | 11/2002 | Matthews | 222/52 |
| 2004/0226962 | A1 | 11/2004 | Mazursky et al. | |
| 2006/0272361 | A1 | 12/2006 | Snodgrass | |
| 2006/0273915 | A1 | 12/2006 | Snodgrass | |
| 2006/0292021 | A1 | 12/2006 | Tu | |
| 2007/0000941 | A1* | 1/2007 | Hadden et al. | 222/52 |
| 2007/0213877 | A1 | 9/2007 | Hart | |
| 2007/0257803 | A1 | 11/2007 | Munro et al. | |

OTHER PUBLICATIONS

Written Opinion PCT/US09/41653 Dated Jul. 16, 2009.

* cited by examiner

MANUAL AND TOUCH-FREE CONVERTIBLE FLUID DISPENSER

BACKGROUND OF THE INVENTION

The present invention is related to dispensing units for dispensing personal care fluids such as liquid soap or foam, and more particularly to a dispenser unit which is convertible between manual operation and automatic (sometimes called "touch-free") operation.

Personal care fluid dispensers, such as those that dispense liquid soap or foam, are readily available in different styles and types. For the purposes of discussion herein, the term "fluid dispenser" is intended to include dispensers of products such as liquid soaps, foam, sanitizers and other personal care products, without limitation.

Fluid dispensers are available which are mounted to a wall and are typically used in commercial settings such as hospitals and restaurants. One type is referred to as a manual type and has an actuating button or panel which requires manual depression or movement by a person, either by hand, arm or foot, in order to get fluid dispensed. Such manual dispensers have a disadvantage in that numerous persons touch the actuation mechanism, so that germs and bacteria can spread, possibly contaminating other users, running counter to the very purpose of a personal care dispensing product.

To address the problem of cross-hand contamination, automatic or so-called "touch-free" dispensers are also available for dispensing fluid product.

Such automatic dispensers typically have a sensing mechanism such as an infrared detector, either active or passive, which detects the presence of a person's hands within a certain vicinity of the dispenser and then dispenses a certain amount of product. Such devices require power, such as with AC power or batteries, as well as a motor with gears or linkages connected to open and close a valve for dispensing the product from a product cartridge. In some cases, the automatic dispenser can fail, leaving the premises without any operable dispenser, even a manual dispenser.

The dispensers typically comprise a unitary complete unit, such that if a single part causes failure of the dispenser, whether it is manual or automatic, the entire unit must be replaced, at significant cost. Keeping a spare dispenser on hand is not typically done at installations. When the dispenser is inoperative, unsanitary conditions will exist until a new one is ordered, obtained and installed.

In some installations, manual dispensers are used, but after a period of time the operator wishes to change or upgrade to an automatic dispenser. This involves purchasing and installing a new automatic dispenser and scrapping the manual dispenser. The same situation exists when an operator wishes to change from an automatic dispenser to a manual dispenser, either temporarily or permanently.

SUMMARY OF THE INVENTION

The present invention is intended to provide a solution to the prior art dispensers, and provides a number of advantages and objectives. However, it should be understood that not all embodiments of the invention will necessarily provide all or any of the advantages or objectives, and the scope of the invention is defined only by way of in the claims.

An objective of the present invention is to provide a personal care fluid dispenser convertible between manual and automatic operation.

An objective of the present invention is to provide a personal care fluid dispenser which is modular so that a non-operative module can be replaced without having to replace the entire dispenser.

An object of the present invention is to provide a personal care fluid dispenser which provides a manual dispensing operation, at low cost and well-suited for certain applications and price points, but which can be converted to automatic operation if the user desires, without having to replace or upgrade the entire unit.

An object of the present invention is to provide a modular unit which can be operative in an automatic mode, but when taken out of service for maintenance or repair, or to replaced by a manual dispenser, can be substituted for a manual unit permanently or temporarily until the automatic unit is operative again, at significantly less cost than replacing the entire dispenser.

An objective of the present invention is to provide a modular personal care fluid dispenser which can be reconstructed to switch the dispenser from a soap dispenser, foam dispenser, sanitizer dispenser or other type of dispenser, to any other type of dispenser without having to replace the entire unit, by exchanging the actuating unit which may be specific for the type of fluid dispensed. Such modular design also allows upgrade of units as they become available in the future, at a lower cost.

It is an object of the present invention to provide a modular unit in which the outside exterior components, which may become soiled and unsanitary, can be taken out of service for cleaning and sanitization, and replaced with another exterior component may be substituted in its place, while keeping the same interior operative actuating unit.

The invention provides a dispensing system for dispensing a personal hygiene product, comprising a housing with a chassis, said housing adapted to removeably accept an actuating unit for dispensing personal hygiene product.

The invention provides a dispenser for dispensing a personal hygiene product, comprising a housing having a chassis, said housing adapted to removeably accept a manual actuating unit within the housing, the actuating unit having a connector for connecting to a source of personal hygiene product and an outlet valve for dispensing the product through the valve when the actuating unit is manually actuated, said housing also adapted to removeably receive an automatic actuating unit having a connector for connecting to a source of hygiene product and an outlet valve, and a detector for detecting the presence of a user in proximity to the housing for actuating the outlet valve to dispense product through the value in response to said detection, said manual and automatic actuating units being capable of being interchanged within the chassis.

The invention provides a dispensing system for dispensing personal hygiene product, comprising a housing with a chassis, a manual actuating unit adapted to be removeably received within the housing, the actuating unit having a connector for connecting to a source of personal hygiene product, and an outlet valve for dispensing the product through the valve when the actuating unit is manually actuated by a user, said manual actuating unit being removable and replaceable by another manual actuating unit or by an automatic actuating unit.

The invention provides a dispensing system for dispensing personal hygiene product, comprising a housing with a chassis, an automatic actuating unit adapted to be removeably received within the housing, the automatic actuating unit having a connector for connecting to a source of personal hygiene product, and an outlet valve for dispensing the product through the valve when the automatic actuating unit detects the presence of a user in the vicinity of the automatic actuating unit, said automatic actuating unit being removable and replaceable by another automatic actuating unit or by a manual actuating unit.

BRIEF DESCRIPTION OF THE DRAWING FIGURES

DESCRIPTION OF THE PREFERRED EMBODIMENT

Figure 1:
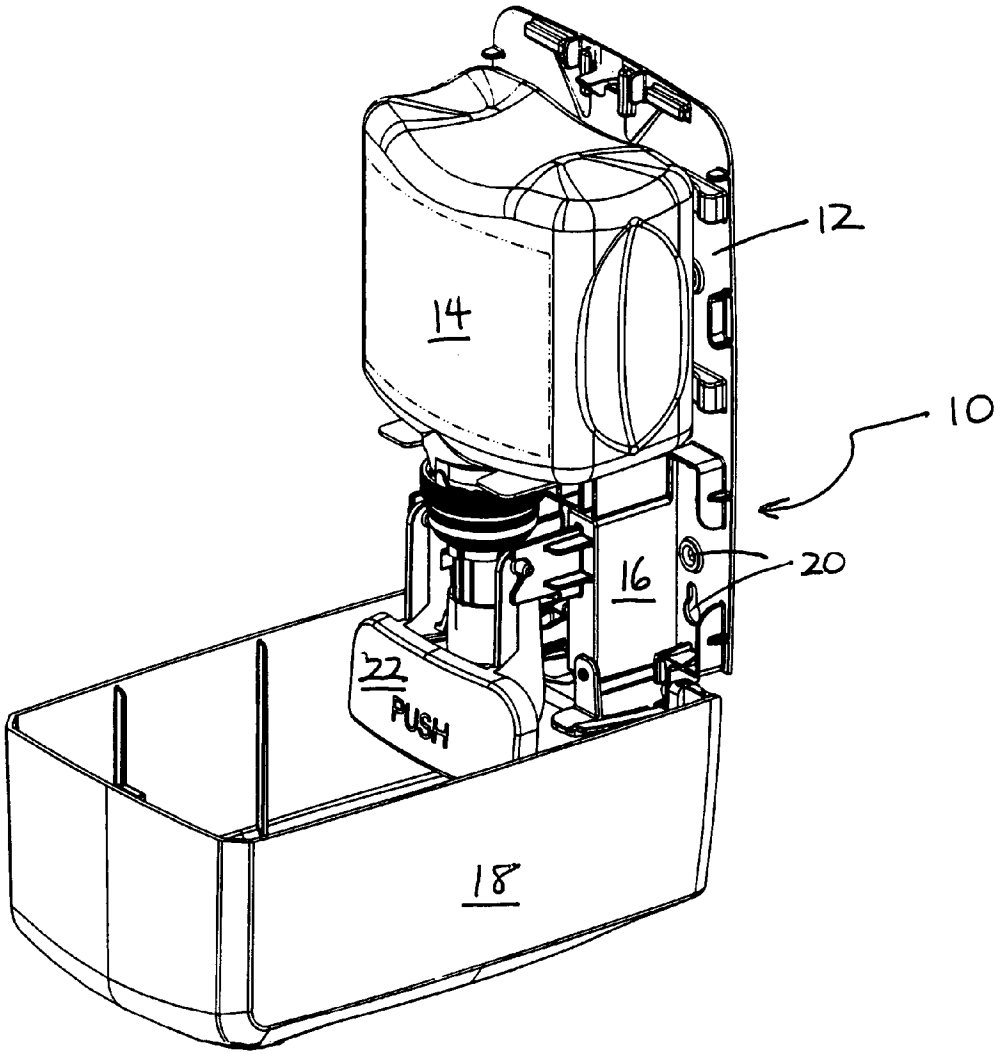
FIG. 1 is a perspective view of a fluid dispenser according to an embodiment of the invention, with a manual actuating unit module installed therein, and with the exterior front cover tilted downward.

An embodiment of the invention will now be described, but the invention is not limited to this embodiment.

As used herein, the term "personal hygiene product" means any product used for cleaning, hygiene or sanitizing, including for example a lotion, foam, spray and liquid.

As used herein, the term "manual actuator", "manual actuator unit", or "manual actuating unit" or the like means an actuator having a button, lever, pedal or other mechanical device which may be moved by a user's hand, arm, head, foot or other body part to effect discharge of personal hygiene product.

As used herein, the term "automatic actuator", "automatic actuator unit" or "automatic actuating unit" or the like means an actuator which detects the presence of a user in the vicinity of the dispenser and in response thereto automatically causes dispensing of a personal hygiene product without requiring mechanical movement of a part by a user. The detector may be infrared, ultrasonic or other type, including recognition of the identity of the user by the user's badge or anatomical features.

The invention provides a dispensing system for dispensing a personal hygiene product, comprising a housing with a chassis, said housing adapted to removeably accept an actuating unit for dispensing personal hygiene product.

The actuating unit may comprise a manual actuator which dispenses personal hygiene product in response to movement of an actuating mechanism by a user. The actuating unit may comprise an automatic actuator which dispenses personal hygiene product in response to detecting the presence of a user in the vicinity of the housing. The manual actuator may be adapted to be actuated by a hand of a user. The manual actuator may be adapted to be actuated by a foot of a user. The automatic actuator may be actuated by an infrared sensor. The automatic actuator may be actuated by an ultrasonic sensor. The automatic actuator may be actuated by a capacitive sensor.

The invention provides a dispenser for dispensing a personal hygiene product, comprising a housing having a chassis, said housing adapted to removeably accept a manual actuating unit within the housing, the actuating unit having a connector for connecting to a source of personal hygiene product and an outlet valve for dispensing the product through the valve when the actuating unit is manually actuated, said housing also adapted to removeably receive an automatic actuating unit having a connector for connecting to a source of hygiene product and an outlet valve, and a detector for detecting the presence of a user in proximity to the housing for actuating the outlet valve to dispense product through the value in response to said detection, said manual and automatic actuating units being capable of being interchanged within the chassis.

The manual actuating unit may comprise a manual actuator which dispenses personal hygiene product in response to movement of an actuating mechanism by a user. The dispenser manual actuator may be adapted to be actuated by a hand of a user. The manual actuator may be adapted to be actuated by a foot of a user. The automatic actuating unit may detect the presence of a hand of a user. The automatic actuating unit may detect the presence of a body of a user. The automatic actuating unit may comprise an infrared sensor. The automatic actuating unit may comprise an ultrasonic sensor.

The invention provides a dispensing system for dispensing personal hygiene product, comprising a housing with a chassis, a manual actuating unit adapted to be removeably received within the housing, the actuating unit having a connector for connecting to a source of personal hygiene product, and an outlet valve for dispensing the product through the valve when the actuating unit is manually actuated by a user, said manual actuating unit being removable and replaceable by another manual actuating unit or by an automatic actuating unit.

The invention provides a dispensing system for dispensing personal hygiene product, comprising a housing with a chassis, an automatic actuating unit adapted to be removeably received within the housing, the automatic actuating unit having a connector for connecting to a source of personal hygiene product, and an outlet valve for dispensing the product through the valve when the automatic actuating unit detects the presence of a user in the vicinity of the automatic actuating unit, said automatic actuating unit being removable and replaceable by another automatic actuating unit or by a manual actuating unit.

FIG. 1 shows a fluid dispensing unit 10 having a manual actuating unit. The dispensing unit 10 can be used for any type of fluid such as a foam, liquid soap, sanitizer or other type. The unit 10 comprises a chassis 12, a fluid reservoir 14, a manual actuating unit 16 and a front pivoting cover 18 shown in the down position.

The chassis 12 is adapted to be mounted on the wall above or near a sink, and mounting holes 20 are provided for the mounting purpose.

The fluid reservoir 14 can be removed from the actuating unit 16 to replace the reservoir when it is empty. An example of a reservoir arrangement and which also includes a keying system which could be used is disclosed in U.S. Ser. No. 11/803,949 filed May 16, 2007, which is incorporated by reference herein.

Disposed below the reservoir in FIG. 1 is the actuating unit 16 which has a push bar button 22 or other actuating mechanism with the word "PUSH" embossed thereon. The push bar 22 has upward arms which have pins which reside in pin openings in push bar bracket 22*a*. When the push bar button 22 is pushed in, the bar pivots inwardly with respect to the pins. The back of the push bar has horizontal arms, the ends of which ride along the bottom of cam surfaces in actuating mechanisms. The actuating mechanisms will be raised, causing the valve in the dispenser to open to deliver fluid product to the user in a controlled dosage amount.

Figure 2:
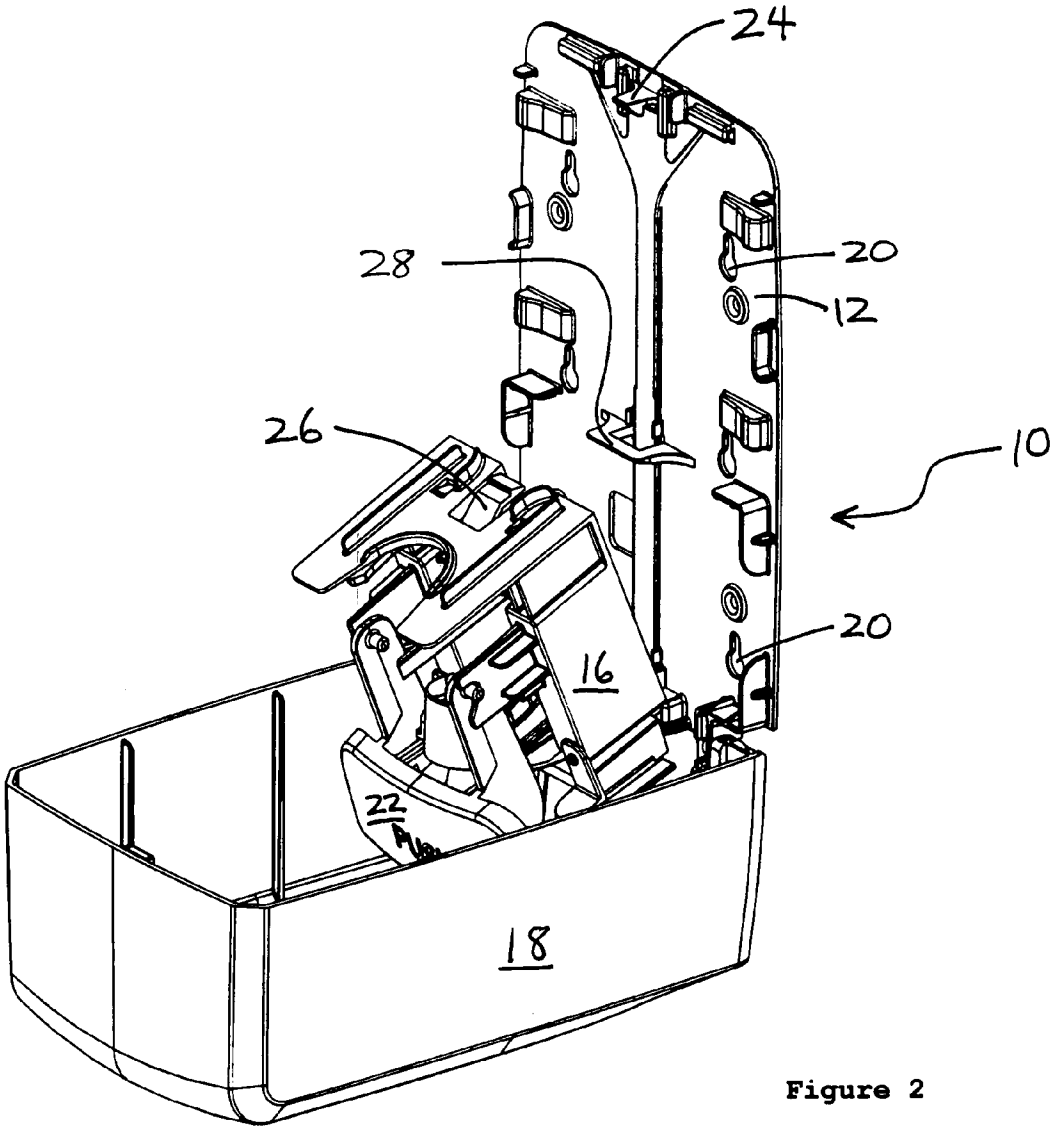
FIG. 2 is a perspective view of the embodiment of FIG. 1, showing the fluid supply reservoir removed, and showing the manual actuating unit module partially released from the back chassis.

FIG. 2 shows the fluid reservoir removed and the actuating unit tilted forward. The back of the chassis 12 can be seen having mounting through-holes 20 for mounting the chassis to a wall. The top of the chassis has a spring latch 24 for holding the front cover 18 in place. The latch can be released by depressing a release tab. In the center of the chassis is a latch bar 28 which accepts a latch tab 26 on the actuating unit to hold it in place. After released of the latch, the actuating unit can tilt forward and then be lifted out of the chassis.

Figure 3:
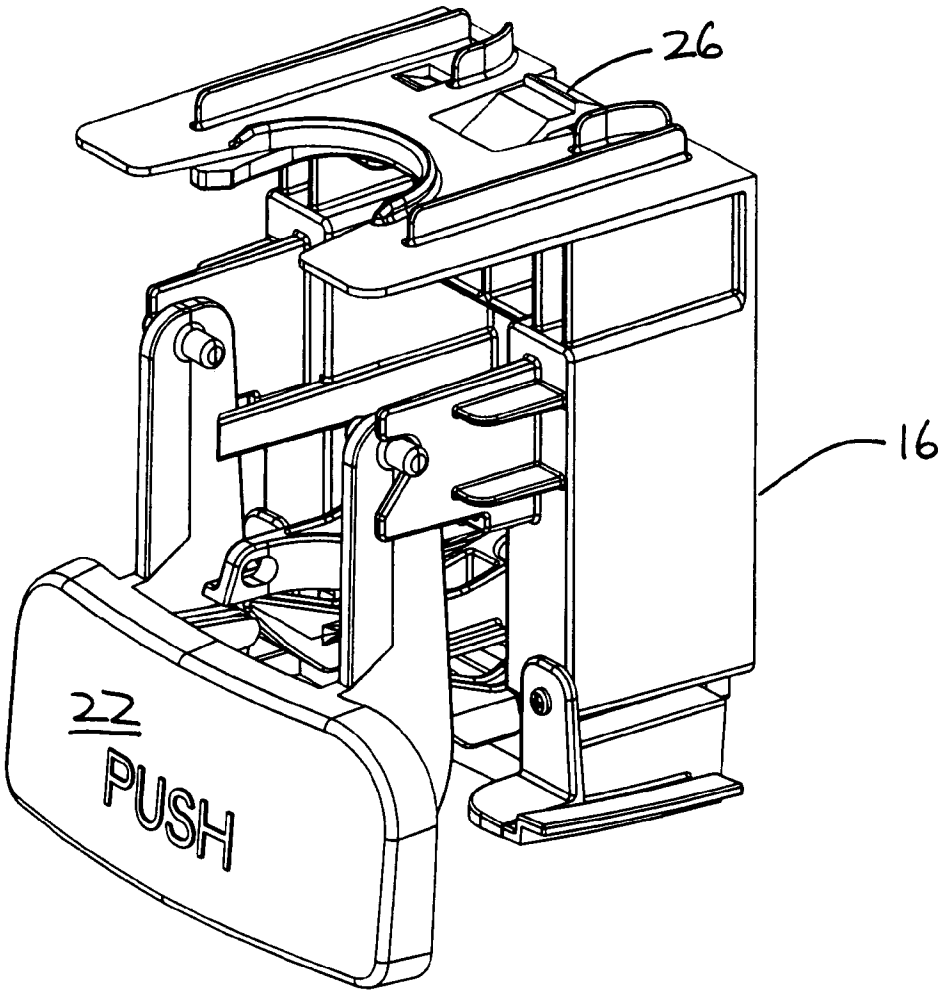
FIG. 3 is a perspective view of the manual actuating unit module of FIGS. 1 and 2 alone.

FIG. 3 shows the manual actuating unit 16 alone, showing more clearly some of the features not obscured by the cover 18.

Figure 4:
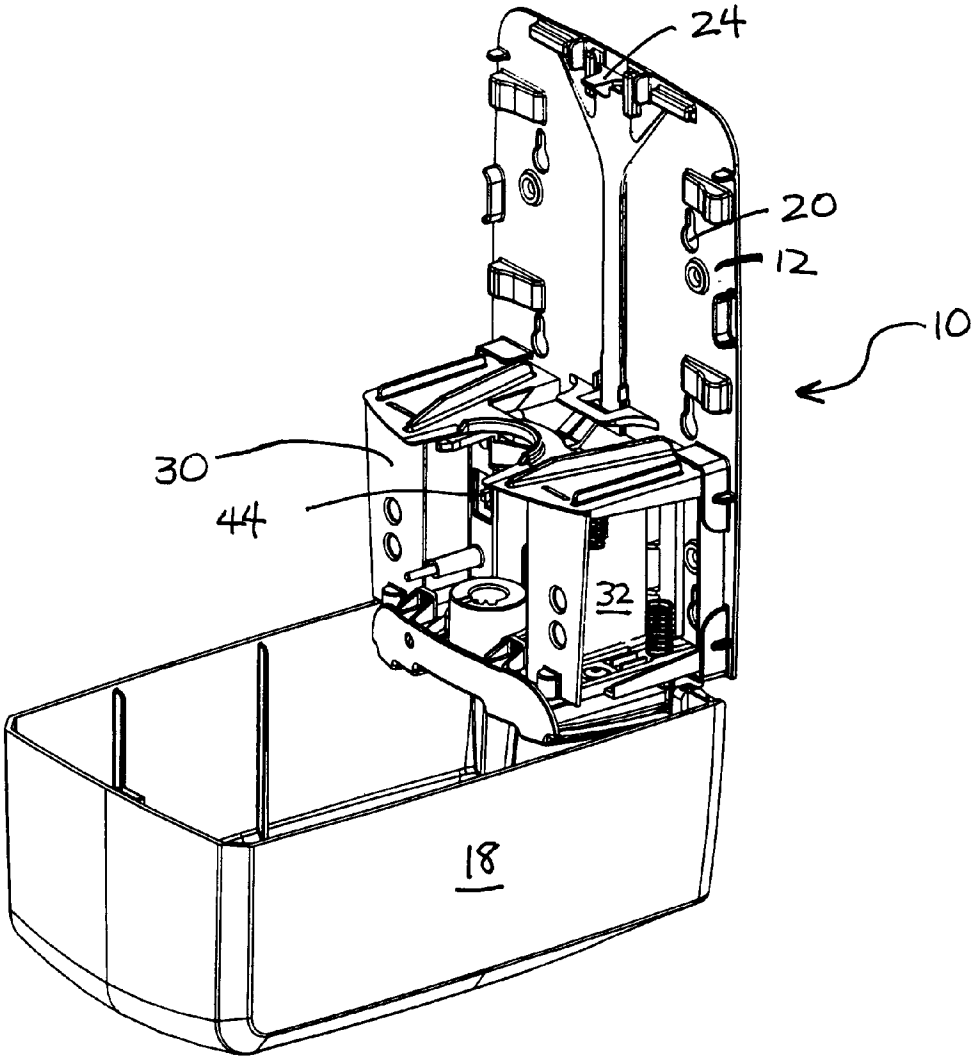
FIG. 4 is a perspective view of the fluid dispenser according to the embodiment of FIG. 1, but with an automatic actuating unit module in place of the manual actuating unit module.

FIG. 4 shows the same chassis of FIG. 1, but with actuating unit 30 being automatically instead of manually operated. Here the actuating unit has a battery box 32 for accepting batteries. Instead of batteries, the unit may be powered by AC power. The batteries power a motor 40. Disposed on the dispenser is a detector which detects the presence of a user in proximity to the housing, whereupon the sensor triggers the actuating unit to dispense product by causing the motor to be energized. On the back left of the automatic actuating unit is a three-position selector switch 44 for selecting the dosage quantity of the fluid dispensed. The detecting unit may be an infrared detecting system, either active with a transmitter and receiver, or entirely passive without a transmitter. Such passive infrared detectors are known in the art, and one example used to turn on water is disclosed in U.S. patent application Ser. No. 11/804,675 filed May 18, 2007, incorporated by reference herein.

Figure 5:
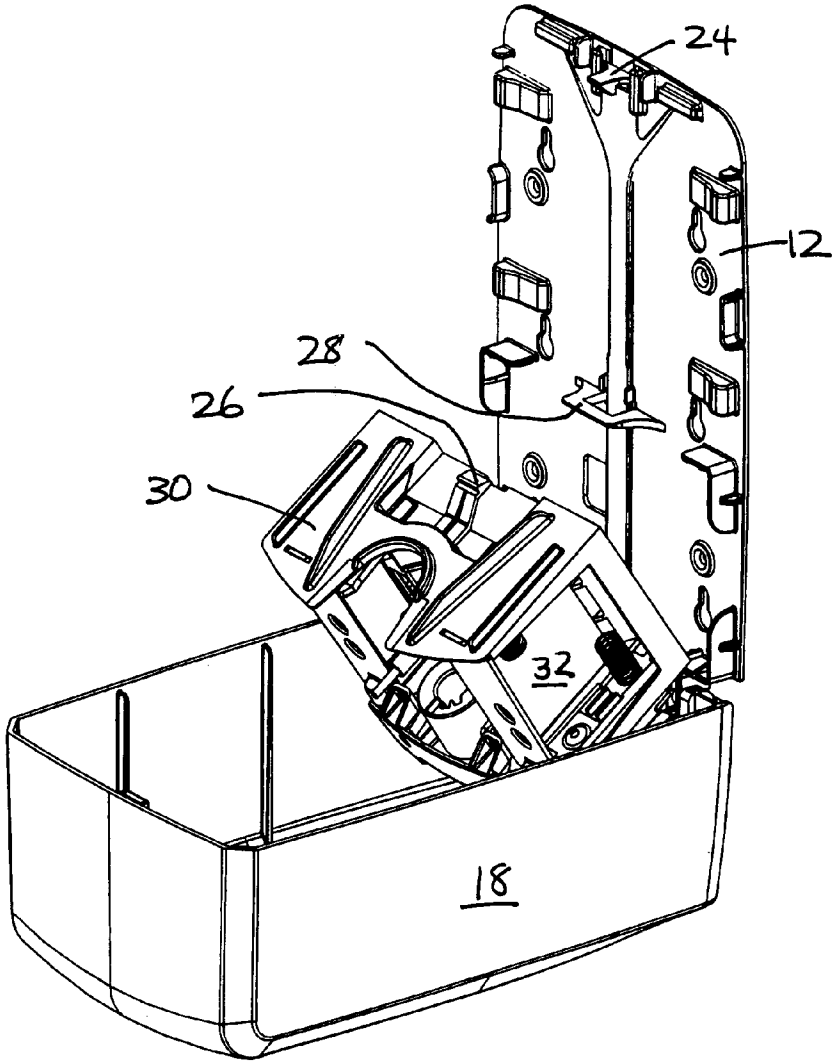
FIG. 5 is a perspective view of the fluid dispenser according to FIG. 4, with the fluid reservoir removed and showing the automatic actuating unit module partially released from the back chassis.

FIG. 5 is similar to FIG. 2 in that it shows the actuating unit being tilted forward in the chassis, although here the unit is automatic instead of manual.

Figure 6:
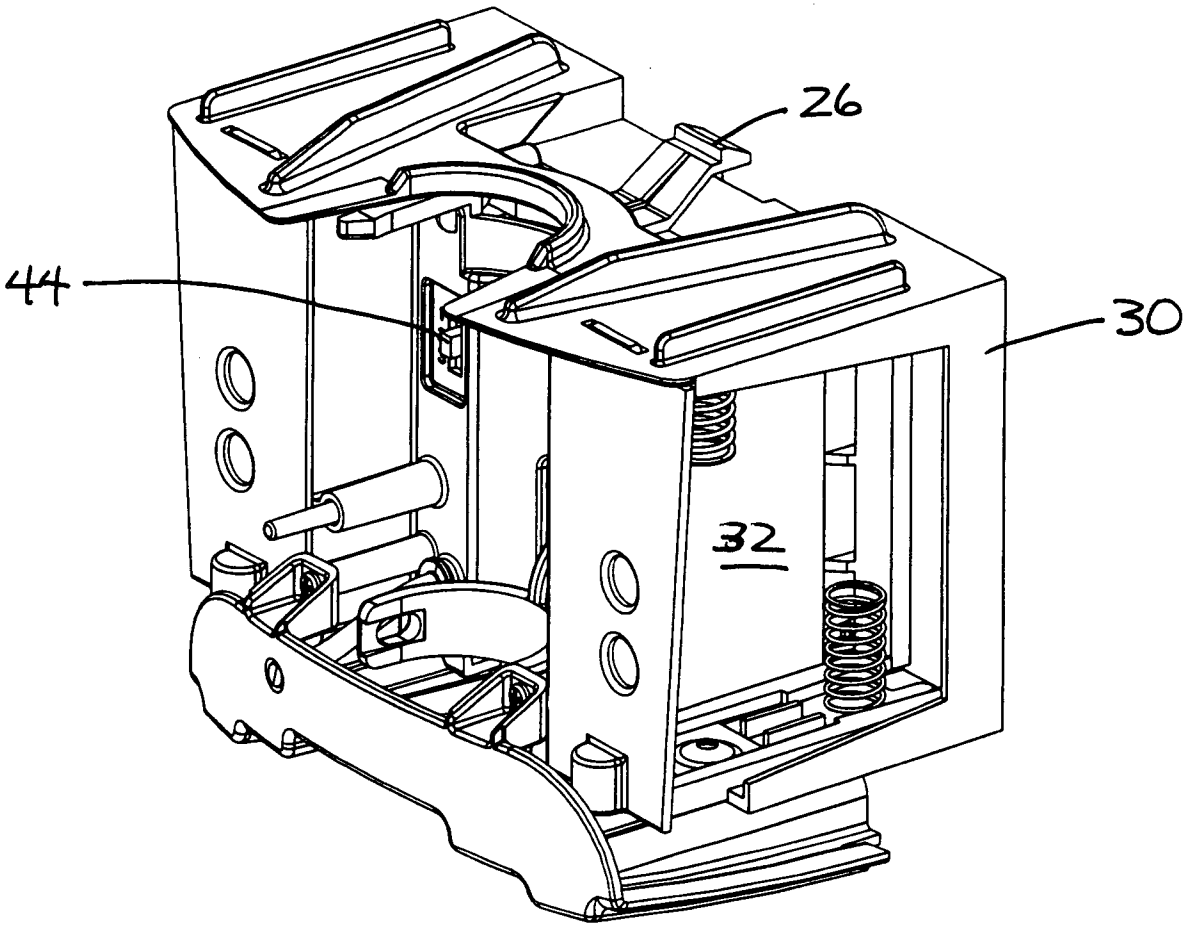
FIG. 6 is a perspective view of the automatic actuating unit module of FIGS. 4 and 5 alone.

FIG. 6 shows the automatic actuating unit alone.

As mentioned above, either or both of the manual and automatic actuating units may be used with the cartridge system disclosed in U.S. Ser. No. 11/803,949 filed May 16, 2007.

The manual actuating unit may be keyed the same or differently than the automatic actuating unit, and may dispense the same or different product.

The cover may be removed by pushing a push button or may require a key, depending on the user preference. The size of the entire unit may be on the order of 10" high by 7" wide by 4" deep, and may be made available in colors by user preference or to indicate the type of fluid that is dispensed.

The dispensing unit may be equipped with one or more status indicator lights indicating the status of batteries or whether the sensor is working. For example, if a red light is flashing once, this would indicate a low battery, and if flashing twice, this would indicate a virtually dead battery. A sensor status light could indicate whether the sensor is working properly (e.g., flashing green=good), or whether an object is obstructing the sensor (e.g., flashing yellow).

The detection sensor may be adjustable for sensitivity and/or range which may differ for different installation environments.

The motor drive may have two or more speeds to accommodate different viscosity products to minimize any spattering of the product.

Using four D cell batteries could provide enough energy to drive the unit through 100,000 dosages, which may be about one year in a typical application.

The front cover may contain a thin vertical view window 46 so that one can observe how much product remains in the product cartridge or reservoir. A sensor may detect when the product is low, by detecting weight of the cartridge or reservoir, or by the number of dosages dispensed from that cartridge or reservoir and expected dosages remaining (even predicting the number of dosages remaining or the days remaining), and display the status by indicator light or numerical display.

Figure 7:
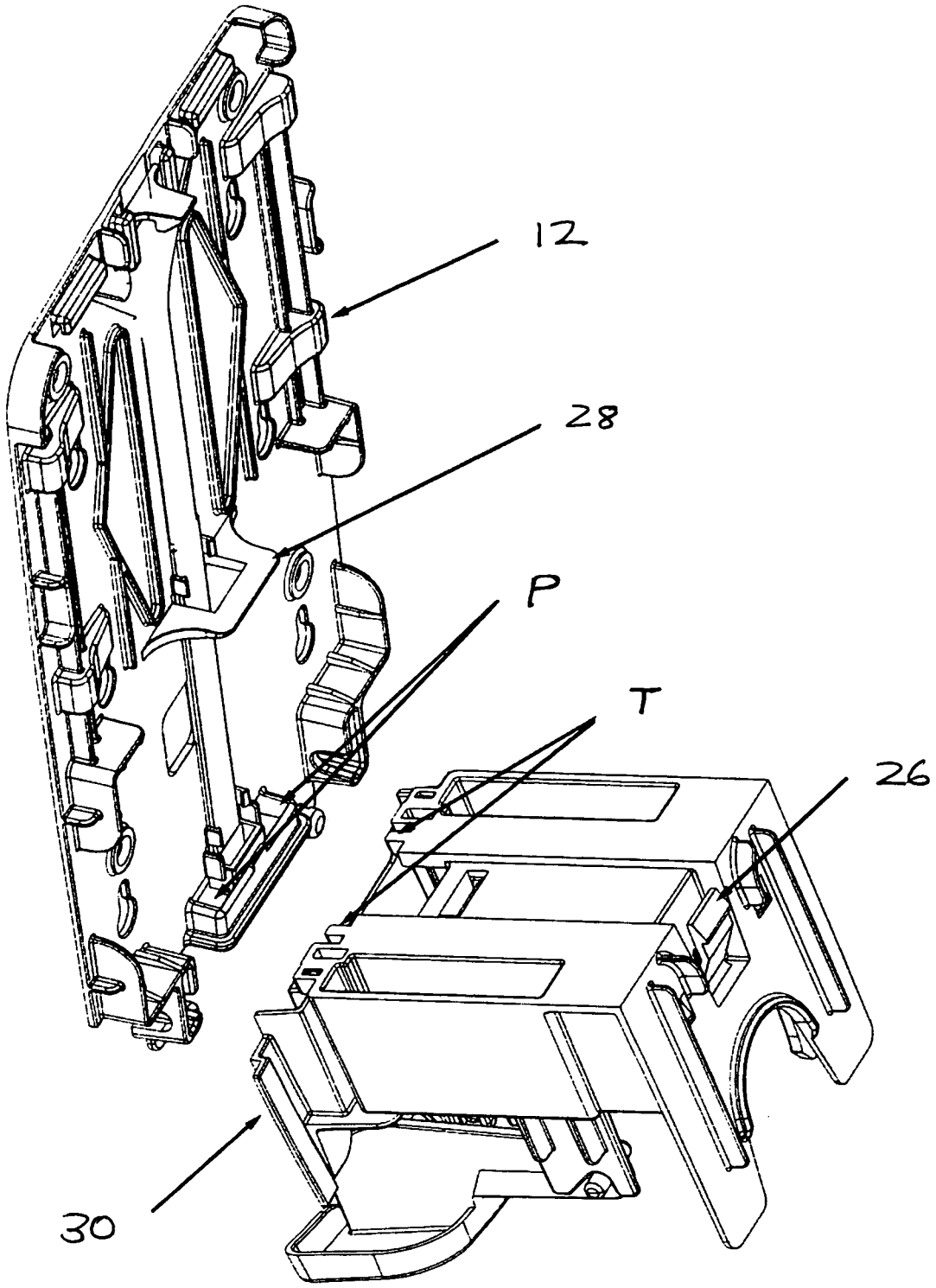
FIG. 7 is a perspective view of the manual actuating unit assembly separated from the chassis.

This dispenser has the unique ability to be easily converted from manual activation to touch free activation before or after installation (or vice versa). As shown in FIG. 7, the manual actuating assembly may be removed from the chassis by depressing a locking tab 26 located at the top of the assembly. The assembly can then be tilted forward and lifted off of the chassis. The push bar 22 may be removed from the cover by pulling its hinge pins out of the push bar bracket 22*a*. The automatic or touch-free actuating assembly 30 can then be installed by placing two mounting tabs T located on the bottom of the assembly into two corresponding pockets P on the chassis. The top of the assembly can then be tilted back towards the chassis until the locking tab 26 snaps into the chassis.

This feature allows a customer to purchase a lower cost manual dispenser and then upgrade it to a touch-free dispenser at a later time without having to replace the entire cover and chassis.

The assemblies do not have to be removed only for upgrade but may also be removed for service, repair or replacement.

A customer or user may also convert from an automatic or touch-free dispenser to manual dispenser either temporarily (for example, to service the automatic unit) or permanently.

Figure 8:
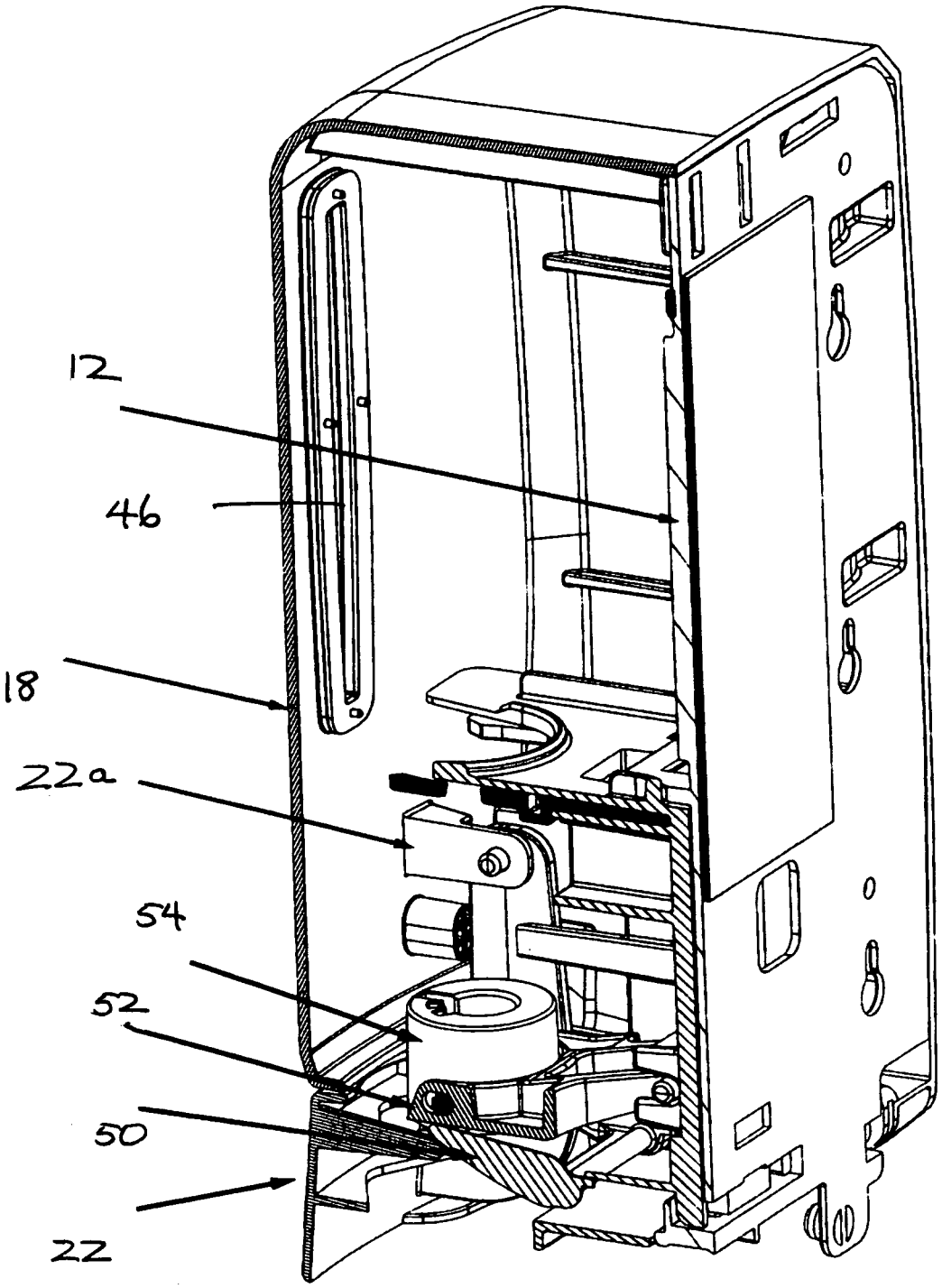
FIG. 8 is a perspective view, in cross-section, of the manual actuating unit assembly mounted on the chassis with the push bar in the rest or idle position.
Figure 9:
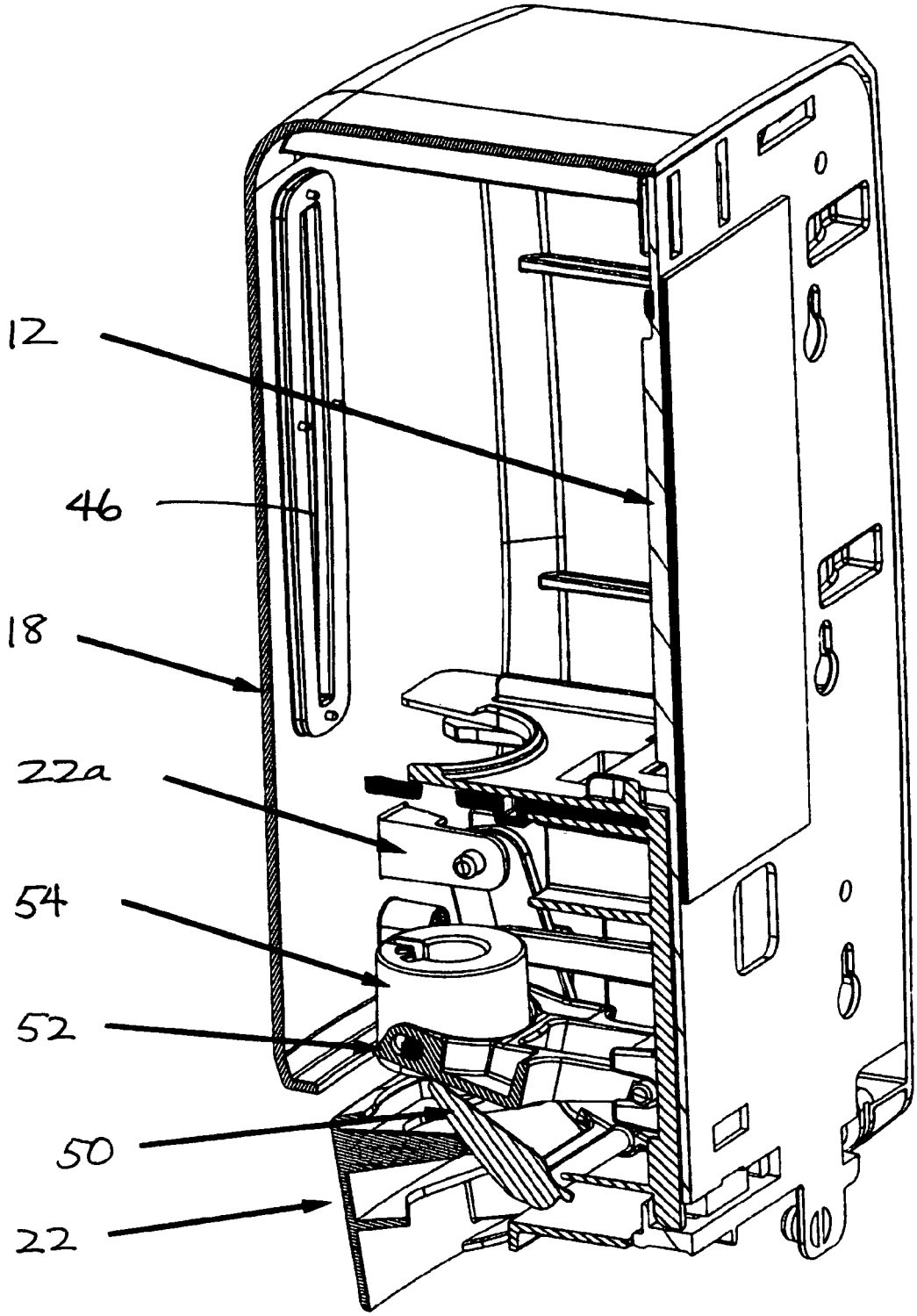
FIG. 9 is a perspective view, in cross-section, of the manual actuating unit assembly of FIG. 8, but with the Push bar in the depressed position to actuate the dispensing of fluid.
Figure 10:
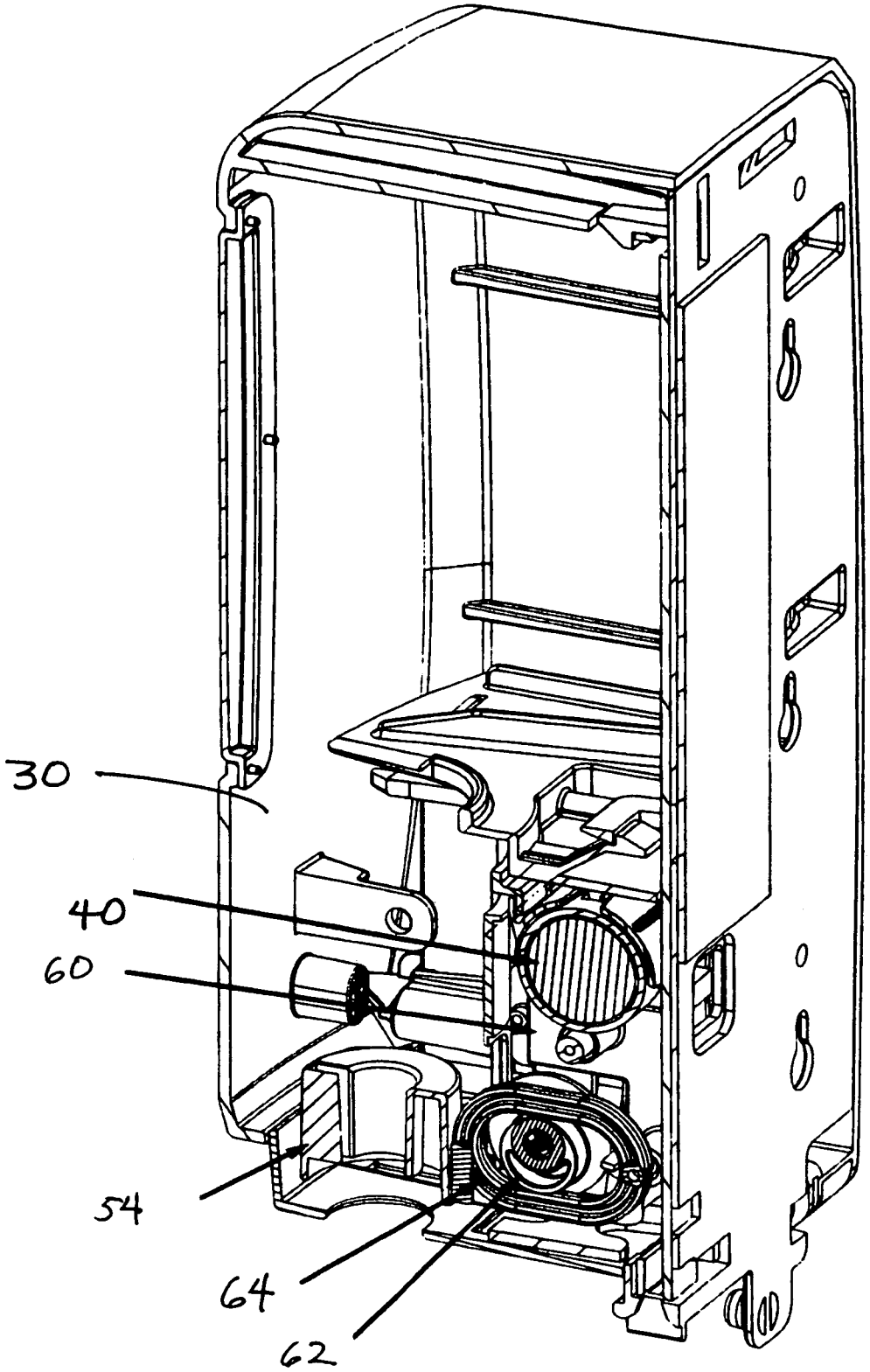
FIG. 10 is a perspective view, in cross-section, of the automatic actuating unit assembly mounted on the chassis in the rest or idle position.

With reference to FIGS. 8 and 9, the operation of the manual dispenser will now be described. To activate the dispenser, a user will push the dispenser's push bar 22 towards the dispenser's chassis 12. The push bar 22 is in contact with the cam 50 and the inward movement of the push bar 22 will cause the cam 50 to rise. The cam 50 is in contact with the pump lever 52 and the rising movement of the cam 50 will cause the pump lever 52 to also rise. The index block 54 is attached to the pump lever 52 at two points which allows it to swivel. As the pump lever 52 rises, so does the index block 54. The nozzle of the pump is in contact with the index block 54. As the index block 54 rises, the nozzle is depressed which causes the pump to operate and dispense liquid into the user's hand. The nozzle maintains an orientation parallel to the dispenser's chassis. The pump lever 52 partially rotates around a pivot point as it rises but the index block 54 is able to swivel to maintain perpendicular contact with the nozzle.

The pump is equipped with an internal spring that urges it into its idle state with the nozzle fully extended. When the user removes pressure against the push bar 22, the pump's spring will push the nozzle, index block 54, pump lever 52, cam 50 and push bar 22 back to their idle positions.

Figure 12:
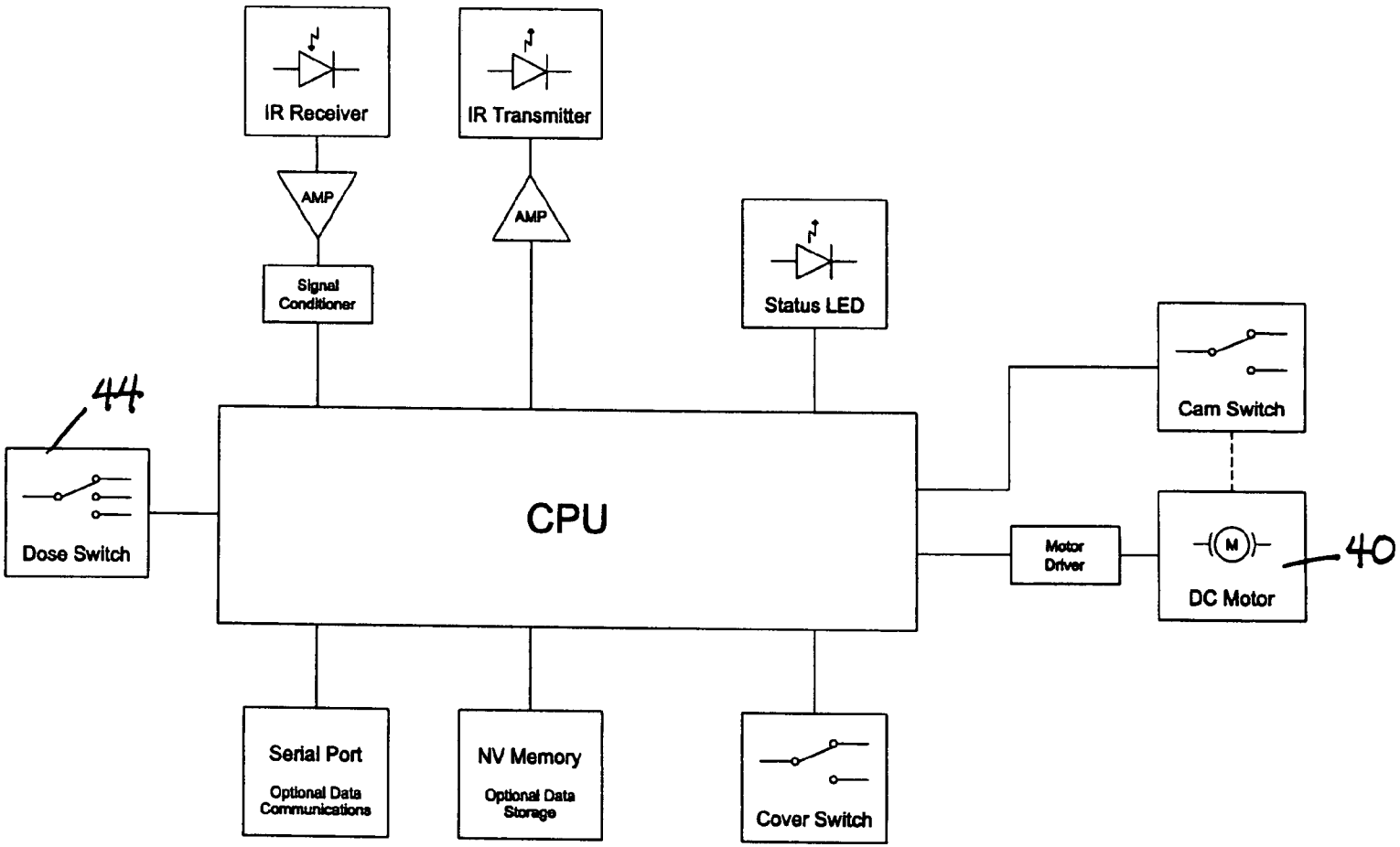
FIG. 12 is a block diagram of the electronic control circuit for the automatic dispensing unit.

FIG. 12 shows the circuit block diagram for the electronic control circuit for the automatic dispensing unit. The electronic circuit comprises a CPU, to which is connected an IR transmitter through an amplifier, an IR receiver through an amplifier and signal conditioner circuit, a dose switch 44 which is located in the dispensing unit as mentioned previously, a motor driver to drive the DC dispensing motor, a cam switch which controls the DC motor 40, and a cover switch. The circuitry may also include a non-volatile (NV) memory to store dispensing and compliance data, and a serial port to connect to a control unit in wired or wireless fashion, to communicate or transmit compliance, dispensing or other data. For example, the dispensing unit may have user identification means to recognize a user by a badge or other means, or by anatomical features of the user. The memory can be used to store the times at which the particular user washers or sanitizes his hands. The memory can also store the number of total number of dispense events to keep track of how much fluid is left in the fluid cartridge for refilling, so that the cartridge may be refilled or replaced before it becomes completely empty, to avoid an empty cartridge at an inopportune time.

The electronic control circuit for the automatic actuating unit assembly is shown in FIG. 12. The unit may be powered by one or more batteries and the unit may be designed to reduce power consumption in an effort to prolong battery life. It may be possible for the unit to operate 9 to 12 months of regular use (<100 activations per day) on one set of four (4) D-cell alkaline batteries. The unit may operate for 100K activations on one set of four (4) D-cell alkaline batteries. The unit may be arranged to be powered by an external 6 VDC source, such as a 110 VAC power supply with step down transformer and AC-DC converter.

The automatic dispenser's electronic circuitry is based on an 8-bit microprocessor (CPU). The CPU acts as the brain of the dispenser and is programmed to control all aspects of its operation. To conserve battery life, the CPU spends most of its time in a low power sleep state. An internal timer (sleep timer) is programmed to "wake up" the CPU approximately every 800 ms.

When the CPU is awakened, it will measure the battery voltage via an internal analog to digital converter (ADC). The CPU will then store the measured battery voltage in its internal memory for later reference. The CPU will then turn on and quickly turn off (pulse) a bi-colored status light emitting diode (LED). This LED is visible from the outside of the dispenser and acts as a heart beat that lets its user know it is alive and functioning. The status LED is able to generate three different colors, green, red and yellow. Each color has a meaning that informs the user of the dispenser's current status. A single green pulse indicates all is well. A single red pulse indicates that the measured battery voltage is low, but that the batteries do not need immediate replacement. A double red pulse indicates that the measured battery voltage is too low and the batteries need to be replaced. And finally, a single yellow pulse indicates that an object is under the dispenser and must be removed for further operation.

After pulsing the status LED, the CPU will pulse an infrared (IR) LED. This IR LED is the source of transmitted IR light used to detect the presence of a user's hand beneath the dispenser. The signal sent from the CPU to the IR LED is amplified to increase the effective brightness and therefore, the range of the IR transmitter. The CPU initially pulses or modulates the IR transmitter 2 times at a frequency of about 2 KHz.

The CPU will look for a return IR signal reflected back from an object located under the dispenser. The return signal is detected by an IR receiver which consists of an IR photo diode. The return signal is then amplified to logic level, conditioned and then sent on to the CPU for processing. The return signal conditioner will filter low frequency noise generated by ambient light sources such as incandescent and florescent lights. It will also "square up" the signal's rising and falling edges so it is readable as a logic state (on or off) by the CPU.

When the return signal reaches the CPU, it will be qualified as a valid or invalid reflection. The transmitted signal is modulated so the return signal must be off when the transmitted signal is off and on when the transmitted signal is on. When this is true, a valid reflection has been detected. If it is not true, the reflection is invalid. An invalid return signal will occur if an object is too distant from the dispenser or no object is there at all.

The CPU only pulses the IR transmitter 2 times to conserve battery power. If no object is detected, the CPU will go back to sleep. If 50% or at least one of the initial two IR pulses returns a valid reflection, the CPU will then pulse the IR transmitter 10 more times to further qualify the presence on an object under the dispenser. If 70% or 7 of the 10 IR pulses return a valid reflection, then the CPU assumes that a user's hand is indeed under the dispenser. If the final 10 pulses do not return at least 7 reflected pulses, the CUP assumes the object under the dispenser has moved away or is too distant and the CPU will go back to sleep. If 7 or more reflected pulses are detected, the CPU assumes a hand is under the dispenser and it will initiate the dispensing of fluid chemical.

Figure 11:
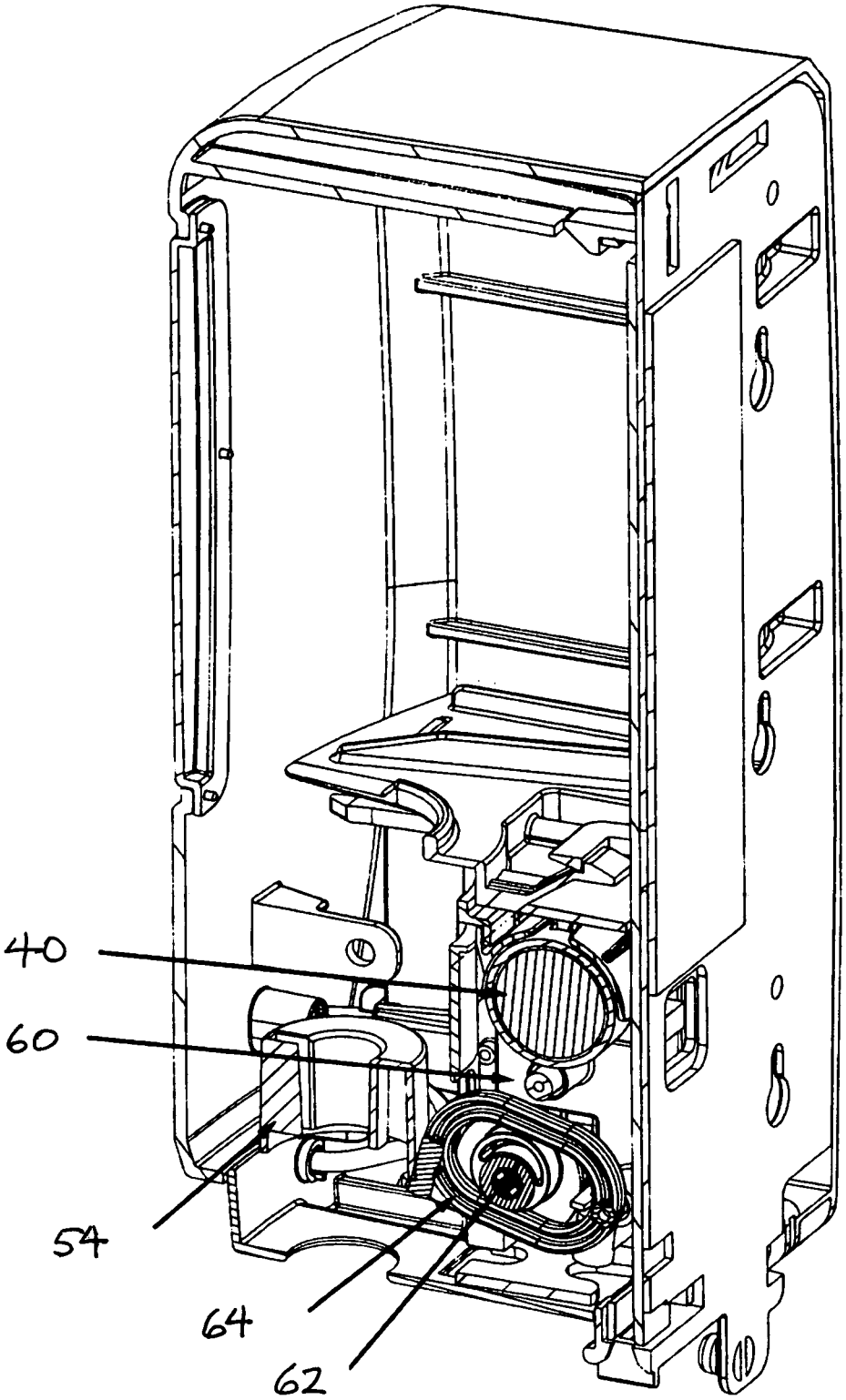
FIG. 11 is a perspective view, in cross-section, of the automatic actuating unit assembly of FIG. 10, but with the motor engaged to effect dispensing of fluid.

Fluid chemical is dispensed via a cylinder pump that is attached to a chemical reservoir that combines to form a cartridge. This cartridge is housed within the dispenser. When a valid reflection has been detected by the CPU, the CPU will activate a DC motor which will mechanically actuate the pump and thus dispense fluid chemical into the user's hand. The DC motor is mechanically attached to the cylinder pump via a gear drive then a cam and finally a lever. One full revolution of the cam will raise and then lower the lever to complete a single pump cycle which dispenses a single dose of chemical, as shown in FIG. 11, showing the motor engaged to dispense fluid. The output volume of a dose is dependent on the size of the cylinder pump.

Before the CPU activates the DC motor 40, it will check the position of the dose switch 44, referred to herein. This switch has multiple user settings to determine the amount of fluid chemical to be dispensed. Each switch setting represents the number of doses the user will receive (e.g., 1, 2 or 3).

The CPU activates the motor 40 by sending a signal to the motor driver circuit. The motor driver circuit acts like a switch that starts or stops the motor by connecting or disconnecting it to the batteries when signaled to do so by the CPU. The motor driver circuit also has the ability to break the motor when signaled to do so by the CPU. When the motor is stopped, it will "coast" under its own momentum for a short period of time but breaking will stop it immediately.

The CPU signal sent to the motor driver is pulse width modulated (PWM) at a calculated duty cycle to control the speed or RPMs of the motor. The CPU will adjust this duty cycle based on the measured battery voltage so the motor's speed remains consistent even as the battery's voltage drops over the course of its usable life. In other words, the motor runs at the same speed regardless of whether the batteries are new or the batteries are almost ready to be replaced.

As the motor 40 runs, it turns the cam. The cam will rotate a full 360 degrees for one dose. The CPU monitors the cam's position via a cam switch which is mechanically attached to the cam. When the cam reaches one full revolution, the cam switch will close. This tells the CPU that one dose has been dispensed. If the dose switch 44 was set to one dose, the CPU will stop and break the motor. This will leave the cam in a known position and thus leaves the pump in its idle position. The CPU will now reset the sleep timer and go back to sleep.

If the dose switch is set for more then one dose, the CPU will count the number of cam revolutions until the number set by the dose switch is reached. The CPU will test for the presence of the user's hand before committing to each successive dose. If the user's hand is not found before the next dose, the CPU will stop and break the motor when the current dose is complete. If the user's hand remains, the CPU will continue running the motor until all doses have been dispensed. In either case, the CPU will go then reset the sleep timer and go back to sleep. The sleep timer will timeout in 800 ms, wake up the CPU and the entire process will be repeated as long as sufficient power is present by batteries or otherwise.

A preferred embodiment of a convertible dispenser has been disclosed, but the invention is not limited to this embodiment and is defined only by way of the following claims.

I claim:

1. A dispensing system for dispensing a personal hygiene product, comprising:

a housing with a chassis, said housing adapted to removeably accept an actuating unit causing dispensing of personal hygiene product wherein the actuating unit is a manual-type capable of operating in only a manual-mode, or is an automatic-type capable of operating in only an automatic-mode, wherein the automatic-type actuating unit comprises an automatic actuator which causes dispensing of personal hygiene product in response to detecting the presence of a user in the vicinity of, but spaced from, the housing, and wherein the housing is capable of accepting both the manual-type and the automatic-type actuating units one at a time; and a cover adapted to enclose the actuating unit in the chassis when in a closed position, and to enable removal of the actuating unit when in an open position;

wherein the housing comprises the manual-type actuating unit during manual operation and the housing comprises the automatic-type actuating unit during automatic operation.

2. The system of claim 1, wherein the actuating unit comprises a manual actuator which dispenses personal hygiene product in response to movement of an actuating mechanism by a user.

3. The system of claim 1, wherein the manual actuator is adapted to be actuated by a hand of a user.

4. The system of claim 2, wherein the manual actuator is adapted to be actuated by a foot of a user.

5. The system of claim 1, wherein the automatic actuator is actuated by an infrared sensor.

6. The system of claim 1, wherein the automatic actuator is actuated by an ultrasonic sensor.

7. The system of claim 1, wherein the automatic actuator is actuated by a capacitive sensor.

8. A dispenser for dispensing a personal hygiene product, comprising:

a housing having a chassis;

said housing adapted to removeably accept a manual actuating unit within the housing, the manual actuating unit operable only in a manual-mode and having a connector for connecting to a source of personal hygiene product and causing dispensing of the product when the actuating unit is manually actuated;

said housing also adapted to removeably receive an automatic actuating unit having a connector for connecting to a source of hygiene product, and a detector for detecting the presence of a user in proximity to but spaced from the housing for causing dispensing of product in response to said detections, the automatic actuating unit operable only in an automatic-mode;

said manual and automatic actuating units being capable of being interchanged within the chassis; and a cover adapted to enclose the actuating unit in the chassis when in a closed position, and to enable removal of the actuating unit when in an open position;

wherein the housing comprises the manual actuating unit during manual operation and the housing comprises the automatic actuating unit during automatic operation.

9. The dispenser of claim 8, wherein the manual actuating unit comprises a manual actuator which dispenses personal hygiene product in response to movement of an actuating mechanism by a user.

10. The dispenser of claim 9, wherein the manual actuator is adapted to be actuated by a hand of a user.

11. The dispenser of claim 9, wherein the manual actuator is adapted to be actuated by a foot of a user.

12. The dispenser of claim 8, wherein the automatic actuating unit detects the presence of a hand of a user.

13. The dispenser of claim 8, wherein the automatic actuating unit detects the presence of a body of a user.

14. The dispenser of claim 8, wherein the automatic actuating unit comprises an infrared sensor.

15. The dispenser of claim 8, wherein the automatic actuating unit comprises an ultrasonic sensor.

16. A dispensing system for dispensing personal hygiene product, comprising:

a housing with a chassis;

a manual actuating unit adapted to be removeably received within the housing, the manual actuating unit being capable of operating in only a manual-mode having a connector for connecting to a source of personal hygiene product, and for causing dispensing of the product when the actuating unit is manually actuated by a user, said manual actuating unit being removable and replaceable by another manual actuating unit, and also being removable and replaceable with an automatic actuating unit being capable of operating in only an automatic-mode, wherein the automatic actuating unit comprises an automatic actuator which dispenses personal hygiene product in response to detecting the presence of a user in the vicinity of but spaced from the housing; and a cover adapted to enclose the actuating unit in the chassis when in a closed position, and to enable removal of the actuating unit when in an open position;

wherein the housing comprises the manual actuating unit during manual operation and the housing comprises the automatic actuating unit during automatic operation.

17. A dispensing system for dispensing personal hygiene product, comprising:

a housing with a chassis;

an automatic actuating unit adapted to be removeably received within the housing, the automatic actuating unit being capable of operating in only an automatic mode and having a connector for connecting to a source of personal hygiene product, and for causing dispensing of the product when the automatic actuating unit detects the presence of a user in the vicinity of but spaced from the automatic actuating unit, said automatic actuating unit being removable and replaceable by another automatic actuating unit being capable of operating in only an automatic-mode, and also being removable and replaceable with a manual actuating unit being capable of operating in only a manual-mode; and a cover adapted to enclose the actuating unit in the chassis when in a dosed position, and to enable removal of the actuating unit when in an open position.

wherein the housing comprises the manual actuating unit during manual operation and the housing comprises the automatic actuating unit during automatic operation.

* * * * *